United States Patent [19]

Hammer et al.

[11] Patent Number: 4,698,549

[45] Date of Patent: Oct. 6, 1987

[54] D.C. LAMP DISCHARGE GAS PUMPING CONTROL

[75] Inventors: Edward E. Hammer, Mayfield Village; Eugene Lemmers, Cleveland Heights, both of Ohio

[73] Assignee: General Electric Company, Schenectady, N.Y.

[21] Appl. No.: 903,913

[22] Filed: Sep. 2, 1986

Related U.S. Application Data

[63] Continuation-in-part of Ser. No. 627,132, Jul. 2, 1984, abandoned.

[51] Int. Cl.[4] ..... H01J 61/42; H01J 61/28

[52] U.S. Cl. ..... 313/490; 313/565

[58] Field of Search ..... 313/490, 565

[56] References Cited

U.S. PATENT DOCUMENTS 3,007,071 10/1961 Lompe et al. .
3,117,248 1/1964 Lake .
3,548,241 12/1970 Rasch et al. .
3,617,792 11/1971 Lake .
3,629,641 12/1971 Hofmann et al. ..... 313/490 X
4,105,910 8/1978 Evans ..... 313/490
4,288,715 9/1981 van Overveld et al. ..... 313/490 X

FOREIGN PATENT DOCUMENTS 1958974 6/1971 Fed. Rep. of Germany ..... 313/565
8649 2/1981 Japan ..... 313/490

*Primary Examiner*—Palmer C. DeMeo
*Attorney, Agent, or Firm*—Nathan D. Herkamp; Philip L. Schlamp; Fred Jacob

[57] ABSTRACT

An amalgam of mercury is placed at the anode end of a low-pressure mercury discharge lamp for D.C. operation to counteract mercury vapor depletion at the anode end of the lamp. The amalgam attracts mercury vapor to the anode end of the lamp when the lamp is turned off to maintain uniform mercury vapor distribution in the lamp.

8 Claims, 1 Drawing Figure

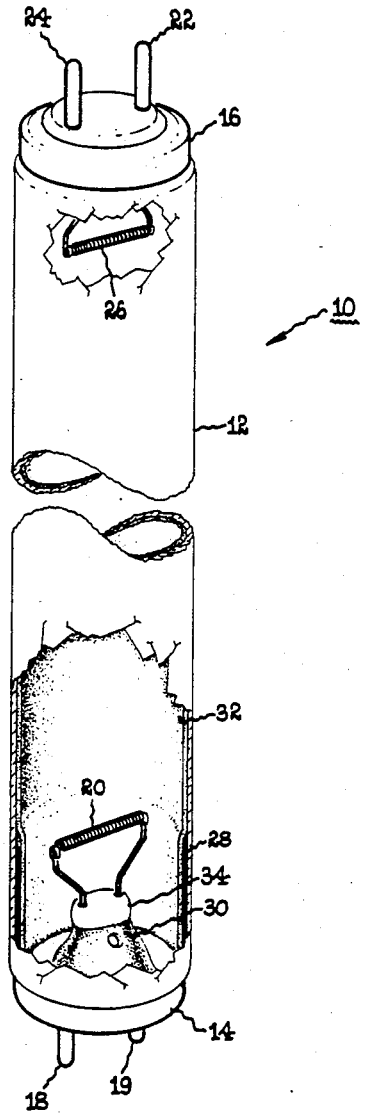
24
22
16
26
10
12
32
20
28
34
30
14
18
19

D.C. LAMP DISCHARGE GAS PUMPING CONTROL

CROSS-REFERENCE TO RELATED PATENT APPLICATION

This application is a continuation-in-part of application Ser. No. 627,132 filed July 2, 1984, and now abandoned.

INTRODUCTION

1. Field of the Invention

This invention relates to low-pressure mercury vapor discharge lamps, and more particularly, to a system for controlling discharge gas pumping in low-pressure mercury vapor discharge lamps.

2. Description of the Prior Art

The operation of low-pressure mercury vapor discharge lamps, such as tubular fluorescent lamps, on direct current electrical power (D.C.) is known to improve lamp efficacy in terms of lumens per watt (LPW). This is primarily due to the fact that the low pressure mercury discharge is more efficient with D.C. operation in producing resonant radiation with lower current density, when the mercury vapor pressure is in the conventionally used range. However, a problem with D.C. operation is the tendency of the discharge to pump or cause migration of mercury vapor from the anode end of the lamp towards the cathode end. This phenomenon, commonly referred to as cataphoresis, causes the mercury to accumulate at the cathode end and to become depleted from the anode end. In the absence of mercury vapor at the anode end, the generation of illumination diminishes, and in the extreme case a large portion of the anode end of the lamp may become substantially dark.

Several prior art methods of preventing mercury depletion at the anode end of a low-pressure mercury vapor discharge lamp exist, which depend for their effectiveness on increasing the rate of diffusion of mercury vapor back toward the anode in opposition to the cataphoretic action of the discharge. The rate of diffusion depends in part on the temperature of the tubular glass envelope walls. Therefore, decreasing the envelope wall temperature as by providing a cooling chamber or protuberance at the anode end of the lamp or by decreasing the current density does to a certain extent counteract the cataphoretic effect. However, this method is not always effective, cannot be applied to all types of lamps, and could require additional electrical power, thereby reducing overall efficiency.

One prior art approach to D.C. operation of mercury vapor discharge lamps is described in U.S. Pat. No. 3,117,248, issued Jan. 7, 1964 to William H. Lake, and assigned to the present assignee. The Lake patent describes several mercury vapor discharge lamp configurations having anode and cathode ends disposed in close proximity with each other and a feedback passage between the electrode regions to allow flow of mercury vapor from the cathode end of the lamp to the anode end. This provides for substantially continuous replenishment of mercury vapor depleted by operation of the lamp in the D.C. mode, but requires a special envelope configuration to accomplish, which configuration is not compatible with straight tubular lamps.

Another approach to D.C. operation of mercury discharge lamps is shown in U.S. Pat. No. 3,617,792, issued Nov. 2, 1971 to William H. Lake and assigned to the present assignee. The Lake '792 patent describes a fluorescent lamp structure in which an inner vitreous tube is sealed within an outer envelope. The inner tube may have a non-circular geometry in order to decrease the diffusion length of the discharge. Electrophoretic circulation of a fill gas, such as argon, between the inner tube and the outer envelope sweeps mercury vapor toward the anode and overcomes cataphoretic pumping of mercury vapor from the anode to the cathode. Therefore, this configuration also requires special shaping of the glass inner tube to overcome cataphoresis and requires significant modification of the conventional straight tubular lamps.

The use of an amalgam in low-pressure mercury discharge lamps has been known for a number of years as a technique for controlling mercury vapor pressure. For example, U.S. Pat. No. 3,548,241 issued Dec. 15, 1970 to E. Rasch et al describes using an amalgam strip deposited on the stem of the lamp to provide mercury vapor pressure regulation. Also, U.S. Pat. No. 4,288,715 issued Sept. 8, 1981 to van Overveld et al describes a mercury vapor pressure control technique which employs an amalgam disposed within a container located within the lamp envelope. Such systems are acceptable for A.C. operation for controlling mercury vapor pressure, but are not useful for controlling cataphoresis.

SUMMARY OF THE INVENTION

Accordingly, an object of the present invention is to provide a low-pressure mercury vapor discharge lamp for operation with a D.C. power supply which overcomes the cataphoretic effect.

The foregoing and other objects are achieved by the present invention, a preferred embodiment of which includes a low-pressure mercury vapor discharge lamp with a rare fill gas and a quantity of mercury within the lamp envelope and having a cathode electrode at one end of the lamp and an anode electrode at the other end and an amalgam disposed within the lamp envelope at the anode end thereof. In a particularly preferred embodiment, the amalgam comprises indium amalgam.

BRIEF DESCRIPTION OF THE DRAWING

Further objects and advantages of the present invention together with its organization, method of operation and the best mode contemplated may best be understood by reference to the following description taken in conjunction with the accompanying drawing, in which:

The single FIGURE is a schematic illustration of a low-pressure mercury vapor discharge lamp embodying the present invention.

DESCRIPTION OF THE PREFERRED EMBODIMENTS

Lamp 10 as shown in the FIGURE includes a generally cylindrical hollow tubular enclosure 12 of vitreous material, such as glass, sealed by generally conically shaped stems of vitreous material, such as glass, and closed at its respective ends by generally circular metal end caps 14, 16. Terminals 18 and 19 extend through end cap 14 and stem 34 into the interior of the enclosure and are connected to an electrode 20 disposed within the enclosure. A pair of terminals 22, 24 extend through end cap 16 and the stem (not shown) enclosed by cap 16 and are connected to respective ends of electrode 26. A rare fill gas, such as argon or krypton, is disposed within the enclosure 12 at conventional pressure along with a small amount of mercury to provide an ionizable medium for producing the discharge upon starting. An amalgam of a mercury vapor control type material is deposited as a coating band 28 on the interior surface of the enclosure 12 at one end of the lamp in close proximity to an electrode, for example, electrode 20 as shown in the FIGURE. A phosphor coating 32 of suitable material is disposed on the inner cylindrical surface along substantially the entire length of enclosure 12. A coating band 30 of amalgam is disposed on the lamp stem 34.

The indium amalgam has a very strong affinity for mercury and is therefore a particularly preferred amalgam. Because the amalgam is not used for controlling mercury vapor pressure and therefore interaction of the amalgam with the mercury vapor during lamp operation is not required, the amalgam is preferably very rich in mercury having a composition of 50–80% mercury and 20–50% indium by weight. Also due to the use of the amalgam only to attract mercury vapor to the anode end of the lamp, the area of exposure for standard fluorescent lamps of approximately 2 to 8 feet in length and approximately 1 to 1.5 inches in diameter is preferably in the range of 1.1 to 7.0 square inches, which is substantially larger than the area of exposure in conventional mercury vapor pressure control applications. The larger the area of exposure, the stronger the attraction tending to return mercury to the anode end of the lamp. Either coating band 28 or 30 may be omitted from the lamp, or the width of either coating band 28 or 30 may be less than that shown so long as an adequate amount of amalgam is disposed at the anode end of the lamp to counteract cataphoresis. The amalgam band 28 on the lamp wall obstructs light emission, so the area of the band 28 is kept to the smallest practical size. Furthermore, the band 28 is limited to the space behind the electrode 20 with respect to the lamp discharge path in order to effectively attract the mercury vapor. If a large area of exposure is required, placing the amalgam on the stem as shown at 30 is preferred. The overlaying of the phosphor 32 over amalgam band 28 does not appreciably reduce the attraction of the mercury vapor by the amalgam. Low lamp envelope temperature can adversely affect lamp efficiency by causing mercury vapor condensation which can drop the mercury vapor pressure below the point at which the illumination is most efficiently produced. The amalgam band 28 of the present invention has negligible effect on lamp envelope temperature. In a test using a lamp 1.5 inches in diameter and 48 inches long, a bulb wall temperature of 50° centrigrade, which is within the optimum range of about 35° to about 55° centrigrade, was readily obtained at the region adjacent the anode 20.

The lamp 10 of the present invention operates as follows. One of the terminals 18, 19 is connected to one terminal of a D.C. power supply (not shown) to operate as an anode, and one of the terminals 22 or 24 is connected to the other terminal of the D.C. power supply to operate as a cathode after lamp starting. Preheat current is applied from a preheat current source (not shown) to the cathode 26 via terminals 22 and 24. D.C. power is then applied between the cathode 26 and the anode 20 to establish an arc therebetween irradiating the phosphor coating 32 to cause the lamp 10 to emit visible light. During lamp operation on D.C. power the mercury vapor will be drawn by cataphoresis toward the end of the lamp containing cathode 26. When the lamp 10 is turned off, the mercury vapor is returned to the anode end of the lamp by the attraction of the amalgam.

The operation of the lamp with a D.C. power supply tends to cause the mercury vapor to migrate toward the cathode end of the lamp by cataphoresis as described in the Introduction above. The amalgam, e.g. an indium amalgam, disposed at the anode end of the lamp 10 attracts the mercury vapor toward the anode 20 at all times and is particularly effective whenever the D.C. power is turned off to counteract the migration of mercury vapor due to the removal of the potential field which causes cataphoresis. In this way, the problem of cataphoresis in mercury discharge lamps operated on D.C. power is overcome, and the advantages of D.C. operation of such lamps can be realized without experiencing the depletion of mercury vapor and the resultant end darkening tendency experienced by prior art discharge lamps. The return of mercury vapor to the anode end during lamp off time by the action of the amalgam occurs at a rate determined by the quantity and area of exposure at the amalgam. Because mercury vapor depletion occurs at a low rate, normally on the order of many hours, the mercury vapor recovery described herein provides a reliable technique for counteracting mercury vapor depletion in most lamp applications. Typical lamp applications include lamp duty cycles in which the lamp is on for several hours, e.g. a working day of 8–10 hours, and off the remainder of the day, which can be accommodated by providing a quantity of amalgam at the anode end of the lamp with an area of exposure adequate to produce a mercury vapor recovery rate approximately equal to the rate of mercury depletion by cataphoresis. Other duty cycles can be accommodated by selection of amalgam quantity and area of exposure. Similarly, the quantity and area of exposure of amalgam can be adapted to accommodate lamp configurations other than straight line, such as circline, U-shaped or compact fluorescent lamps. Additionally the present invention allows vertical operation of D.C. operated fluorescent lamps with either anode or cathode end at the top, because the amalgam deposit has sufficient attraction for the mercury vapor to balance the migration by cataphoresis, even if cataphoresis is assisted by gravitational attraction of mercury vapor toward the cathode in lamps operated with the cathode at the bottom.

Therefore, it will be appreciated that the present invention provides a simple, effective means to overcome cataphoresis in D.C. operated low-pressure mercury vapor discharge lamps.

What we claim as new and desire to secure by Letters Patent of the United States is:

1. A low-pressure mercury discharge lamp for operation on DC electrical power comprising:

an elongated cylindrical sealed vitreous envelope means having a fluorescent phosphor coating material disposed on the inner surface thereof;

anode electrode means disposed within said envelope means at a first end thereof;

cathode electrode means disposed within said envelope means at a second end thereof spaced from said first end;

an inert fill gas disposed within said envelope means;

a discharge gas comprising mercury vapor;

an amalgam disposed as a generally circular band having an area in the range of 1.1 to 7.0 square inches on the interior surface of said envelope means at only said first end thereof, said amalgam having a composition of 50 to 80 wt. % mercury and 20 to 50 wt. % indium, and said phosphor coating material overlaying said amalgam.

2. The lamp of claim 1 wherein the wall temperature of said envelope means is no greater than about 55° C.

3. A low-pressure mercury vapor discharge lamp for operation on DC electrical power comprising:

an elongated straight cylindrical sealed vitreous envelope means for operation in a generally vertical orientation having a fluorescent phosphor coating material disposed on the inner surface thereof;

anode electrode means disposed within said envelope means at a first end thereof;

cathode electrode means disposed within said envelope means at a second end thereof spaced from said first end;

an inert fill gas disposed within said envelope means;

a discharge gas comprising mercury vapor;

an amalgam disposed as a generally circular band behind said anode electrode means with respect to the lamp discharge path on the interior surface of said tubular envelope means at only said first end thereof, said amalgam having a composition of 50 to 80 wt. % mercury and 20 to 50 wt. % indium; and said phosphor coating material overlaying said amalgam.

4. The lamp of claim 3 wherein the wall temperature of said envelope means is no greater than about 55° C.

5. A low-pressure mercury discharge lamp for operation on DC electrical power comprising:

an elongated cylindrical sealed vitreous envelope means having a fluorescent phospor coating material disposed on the inner surface thereof;

anode electrode means disposed within said envelope means at a first end thereof;

cathode electrode means disposed within said envelope means at a second end thereof spaced from said first end;

an inert fill gas disposed within said envelope means;

stem means disposed at said first end closing said first end of said envelope means and having a pair of terminals extending therethrough for making electrical contact to said anode electrode means;

a discharge gas comprising mercury vapor;

an amalgam disposed as a generally circular band on said first stem means and on the interior surface of said envelope means at only said first end thereof, said amalgam having a composition of 50 to 80 wt. % mercury and 20 to 50 wt. % indium, and wherein said phosphor coating material overlays said amalgam band disposed on the interior surface of said envelope means.

6. The lamp of claim 5 wherein the total surface area of said amalgam bands is in the range of 1.1 to 7.0 square inches.

7. A low-pressure mercury vapor discharge lamp for operation on DC electrical power comprising:

an elongated straight cylindrical sealed vitreous envelope means for operation in a generally vertical orientation having a fluorescent phosphor coating material disposed on the inner surface thereof;

anode electrode means disposed within said envelope means at a first end thereof;

cathode electrode means disposed within said envelope means at a second end thereof spaced from said first end;

first stem means disposed at said first end closing said first end of said envelope means and having a pair of terminals extending therethrough for making electrical contact to said anode electrode means and second stem means disposed at said second end closing said second end of said envelope means and having a pair of terminals extending therethrough for making electrical contact to said cathode electrode means;

an inert fill gas disposed within said envelope means;

a discharge gas comprising mercury vapor;

an amalgam having a composition of 50 to 80 wt. % mercury and 20 to 50 wt. % indium disposed as a first generally circular band on said first stem means;

a second generally circular band of said amalgam disposed behind said anode electrode means with respect to the lamp discharge path on the interior surface of said straight tubular envelope means at said first end thereof, wherein said phosphor coating material overlays said second band of amalgam.

8. The lamp of claim 7 wherein said first and second amalgam bands have a combined surface area in the range of from about 1.1 to 7.0 square inches.

* * * * *